US008603016B2

(12) United States Patent
Shimizu et al.

(10) Patent No.: US 8,603,016 B2
(45) Date of Patent: Dec. 10, 2013

(54) WALKING ASSISTANCE DEVICE

(75) Inventors: Hideo Shimizu, Wako (JP); Kouji Okazaki, Wako (JP); Hideaki Takahashi, Wako (JP); Taiji Koyama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 345 days.

(21) Appl. No.: 12/987,395

(22) Filed: Jan. 10, 2011

(65) Prior Publication Data

US 2011/0172570 A1 Jul. 14, 2011

(30) Foreign Application Priority Data

Jan. 11, 2010 (JP) ..... 2010-003500
Jan. 11, 2010 (JP) ..... 2010-003505

(51) Int. Cl.
*A61H 3/00* (2006.01)

(52) U.S. Cl.
USPC ..... 601/35; 601/5; 602/23

(58) Field of Classification Search
USPC ..... 601/5, 23, 26, 33, 35, 84, 97, 98; 602/5, 602/6, 12, 16, 19, 23, 24, 25, 26, 32, 36
See application file for complete search history.

(56) References Cited

U.S. PATENT DOCUMENTS

| | | | | |
|---|---|---|---|---|
| 2009/0306554 | A1* | 12/2009 | Yasuie | 601/5 |
| 2010/0036302 | A1* | 2/2010 | Shimada et al. | 602/16 |
| 2010/0152630 | A1* | 6/2010 | Matsuoka et al. | 601/35 |
| 2011/0218466 | A1 | 9/2011 | Takahashi et al. | |

FOREIGN PATENT DOCUMENTS

| | | |
|---|---|---|
| JP | 11-225858 | 8/1999 |
| JP | 2001-147635 | 5/2001 |
| JP | 2006-320349 | 11/2006 |
| JP | 2006-320350 | 11/2006 |
| JP | 2007-29704 | 2/2007 |
| JP | 2007-152035 | 6/2007 |
| JP | 2009-095645 | 5/2009 |

* cited by examiner

*Primary Examiner* — Quang D Thanh
(74) *Attorney, Agent, or Firm* — Rankin, Hill & Clark LLP

(57) ABSTRACT

In a walking assistance device configured to apply a walking assistance force to a femoral part of a user, a walking assistance force provided by a power generator mounted on a pelvic support assembly is transmitted to a femoral part of the user via a femoral support assembly. The femoral support assembly includes a swing arm (60, 62) having a base end connected to an output end of the power generator and a free end opposing a front part of the femoral part of the user, a femoral support member (68, 70) pivotally connected to the free end of the swing arm and having a support surface engaging the front part of the femoral part of the user, and a femoral belt (73, 74) passed around the femoral part of the user and having two ends attached to corresponding lateral ends of the femoral support member. Thereby, the femoral support member is enabled to accommodate changes and/or variations in the contour of the femoral part of the user. Ensure a comfortable fit and a reliable power transmission, the femoral belt may include a main belt portion (83, 85) having a base end connected to one of the lateral ends of the femoral support member and a free end releasably connected to the other lateral end of the femoral support member, and an auxiliary belt portion (84, 86) bifurcated from an intermediate part of the main belt portion and having a free end connected to the swing arm.

11 Claims, 4 Drawing Sheets

WALKING ASSISTANCE DEVICE

TECHNICAL FIELD

The present invention relates to a walking assistance device, and in particular to a walking assistance device including a femoral support assembly configured to be worn on a femoral part of a user to apply thereto a walking assistance force generated by a power generator.

BACKGROUND OF THE INVENTION

Previously proposed is a walking assistance device that includes a power generator such as an electric motor to apply a working assistance force to a lower limb of a user for the purposes of assisting the walking movement of the user, and/or rehabilitating the walking impairment of the user by helping the user to regain the motor coordination that is required for the user to walk. See patent document 1 (Japanese patent laid-open publication JP2006-320349A), patent document 2 (Japanese patent laid-open publication JP2006-320350A), and patent document 3 (Japanese patent laid-open publication JP2007-152035A).

Such a walking assistance device typically includes a pelvic support assembly consisting of a C-shaped main frame configured to be worn on a pelvic part of the user and extending from a lower back part of the user to either side of the pelvic part of the user and an abdominal belt for securing the main frame to the pelvic part of the user, a pair of power generators mounted on either lateral end of the main frame (at parts corresponding to the hip joints of the user) and a pair of femoral support assemblies for transmitting the power generated by the power generators to the corresponding femoral parts of the user.

A previously proposed femoral support assembly includes an arm member or a swing arm consisting of an elongated flat bar member made of a relative stiff material. The swing arm includes a base end attached to the output end of the corresponding power generator, a free end located on the front side of a lower femoral part of the user and an intermediate part extending between the base end to the free end of the swing arm along the outer contour of the femoral part of the user. Therefore, the swing arm is twisted by about 90 degrees as it extends from the base end to the free end. The free end is fitted with a flexible belt passed around the lower femoral part of the user in a releasable manner. See patent document 4 (Japanese patent laid-open publication JP2009-95645A), for instance.

The femoral support assembly for a walking assistance device is required to be able to apply the power generated by the power generator to the femoral part of the user in a reliable manner on the one hand, and to fit favorable onto the body of the user without causing discomfort or stress to the user.

BRIEF SUMMARY OF THE INVENTION

In view of such problems of the prior art, a primary object of the present invention is to provide a walking assistance device including a femoral support assembly that can transmit a walking assistance force generated by a power generator to a femoral part of the user in reliable manner.

A second object of the present invention is to provide a walking assistance device including a femoral support assembly that can transmit a walking assistance force generated by a power generator to a femoral part of the user without causing any undue discomfort and/or stress.

According to the present invention, such objects can be accomplished by providing a walking assistance device configured to apply a walking assistance force to a femoral part of a user, comprising: a pelvic support assembly configured to be worn on a pelvic part of a user to support a power generator and a femoral support assembly configured to transmit a walking assistance force generated by the power generator to a femoral part of the user; wherein the pelvic support assembly comprises a main frame configured to be worn on a pelvic part of the user and extending from a lower back of the user to either side of the pelvic part of the user forming a C-shape in plan view, at least one free end of the main frame being configured to support the power generator at a position corresponding to a hip joint of the user, and an abdominal belt attached to the main frame at base ends thereof, extending along an inner periphery of the main frame and configured to be detachably passed along an abdominal part of the user; and wherein the femoral support assembly comprises a swing arm having a base end connected to an output end of the power generator and a free end opposing a front part of the femoral part of the user, a femoral support member pivotally connected to the free end of the swing arm and having a support surface engaging the front part of the femoral part of the user, and a femoral belt passed around the femoral part of the user and having two ends attached to corresponding lateral ends of the femoral support member.

Owing to the combination of the femoral support member and femoral belt, the femoral support assembly is capable of transmitting the walking assistance force generated by the power generator to the femoral part of the user in a reliable manner and minimizing the discomfort and stress to the user by optimally fitting on the femoral part of the user. In particular, because the femoral support member is pivotally connected to the free end of the swing arm, the femoral support member is enabled to accommodate the angular changes in the front surface of the femoral part of the user so that the fit of the femoral support member on the femoral part of the user can be optimized without regard to the build of the user and movements of the muscles of the femoral part.

The pivotal connection between the femoral support member and the free end of the swing arm can be most readily accomplished by connecting the free end of the swing arm to the femoral support member via a spherical joint.

If the femoral support member is allowed to pivotally move freely with respect to the free end of the swing arm, the position of the femoral support member may be unpredictable and unstable so that the user may experience some inconvenience when engaging the femoral belt to the femoral support member. To limit the angular movement of the femoral support member with respect to the free end of the swing arm so as to ensure the optimum fit of the femoral support member on the femoral part of the user without allowing the femoral support member to undergo an excessive angular movement, the free end of the swing arm and femoral support member may be provided with mutually cooperating stopper surfaces that limit a tilting movement of the femoral support member relative to the free end of the swing arm within a prescribed limit.

To impart a suitable flexibility and resiliency to the femoral support member so as to achieve an optimum fit, the femoral support member may comprise a plate member having a plurality of vertical slots arranged laterally formed therein.

To have the two ends of the femoral belt to be attached to corresponding lateral ends of the femoral support member in a releasable manner, the femoral support member may be provided with a pair of engagement features on either lateral end, one of the engagement features permanently engaging the corresponding end of the femoral belt while the other engagement feature releasably engages the other end of the femoral belt.

The femoral belt is required to oppose the tendency to sag during use caused not only by the gravitational force but also by the tapering shape of the lower femoral part of the user. According to a preferred embodiment of the present invention, the femoral belt includes a main belt portion having a base end permanently connected to one of the lateral ends of the femoral support member and a free end releasably connected to the other lateral end of the femoral support member via a buckle, and an auxiliary belt portion bifurcated from an intermediate part of the main belt portion and having a free end connected to an intermediate part of the swing arm so that the auxiliary belt suspends the main belt portion against the downward shifting thereof.

Also by providing a frustoconical shape to the femoral belt when the two ends of the femoral belts are engaged by the femoral support member, the femoral belt can be optimally fitted on a lower femoral part of the user which has a tapering shape.

According to a certain aspect of the present invention, the buckle includes a tongue piece connected to the free end of the main belt portion and a corresponding engagement feature provided on the corresponding lateral end of the femoral support member, and the tongue piece includes at least a pair of lateral bars arranged in a lengthwise direction of the femoral belt, the free end of the femoral belt being wrapped around one of the lateral bars and passed between the other lateral bar and an adjacent part of the femoral belt, and opposing surfaces of the two adjacent parts of the femoral belt being provided with mutually cooperating surface fastener parts. Thereby, the femoral belt is prevented from loosening during use.

If the femoral belt is at least partly elastic, the femoral support member is enabled to accommodate the variations in the build of the user and movements of the muscles of the femoral part of the user during use.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
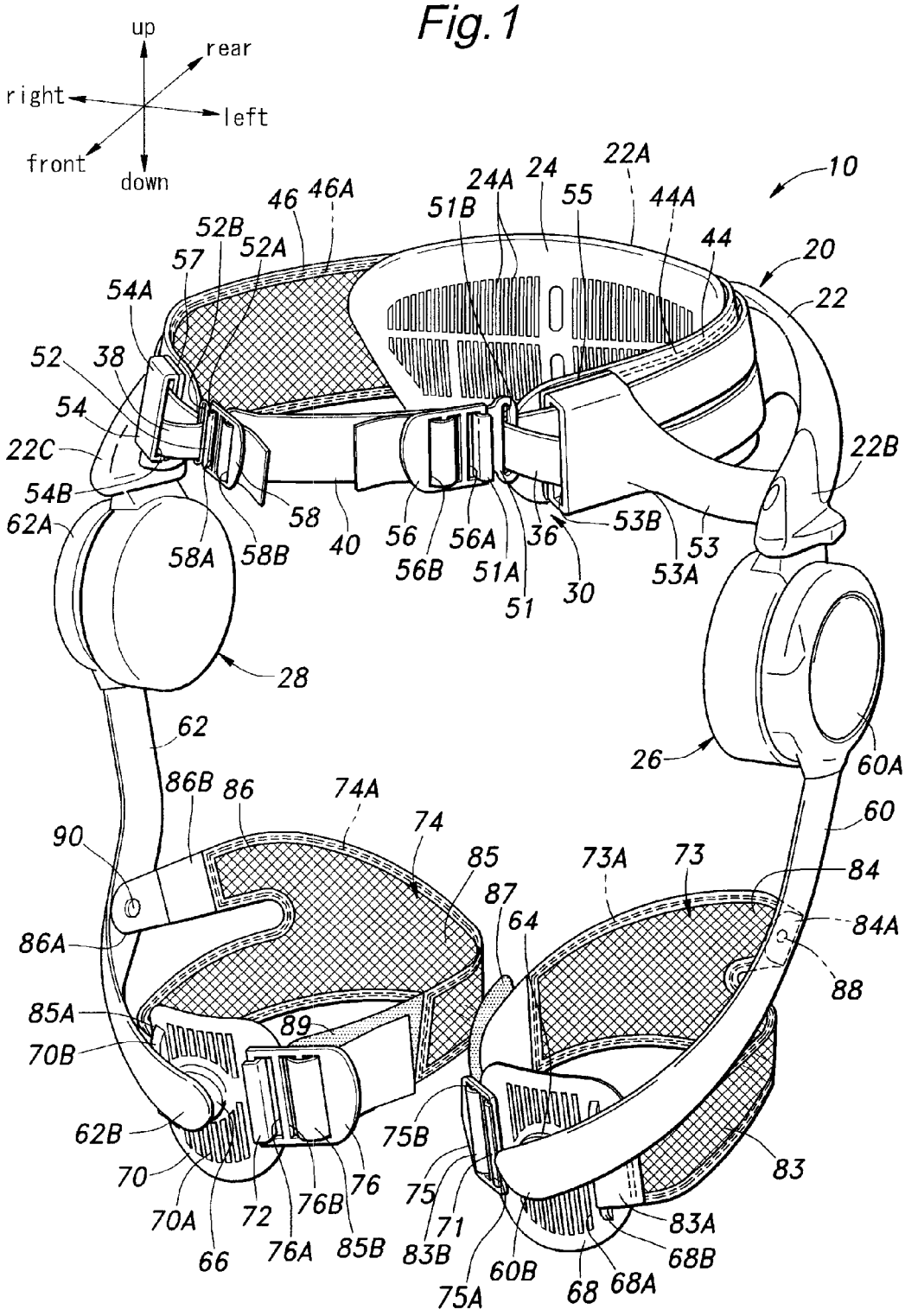
FIG. 1 is a perspective view of a walking assistance device embodying the present invention.

An embodiment of the walking assistance device of the present invention will now be described in the following with reference to FIG. 1. In the following description, the direction of the walking assistance device will be based on the directional arrows shown in each of the drawings. When the device is worn by the user, the front and back directions of the walking assistance device coincide with the coronal axis, while the left and right directions coincide with the sagittal axis.

The walking assistance device 10 is provided with a pelvic support assembly 20. The pelvic support assembly 20 is configured to be worn on the pelvic part of the user, and includes a main frame 22 that extends outwardly from a lower back part of the user to either side of the pelvic part to form a C-shape when viewed in plan view. The main frame 22 is formed with molded plastic material such as polyamide resin, glass fiber reinforced plastic material carbon fiber reinforced plastic material or other material having a high stiffness and mechanical strength.

A middle part 22A of the main frame 22 is formed with a storage opening (not shown in the drawings) passed across the thickness thereof for receiving an electronic unit including a control unit and a battery (not shown in the drawings). A back support member 24 is attached to the inner side of the middle part 22A of the main frame 22. The back support member 24 is made of a plastic plate member having a high resiliency, and is formed with a number of vertical slots 24A arranged laterally at a regular interval for promoting air permeability and enhancing resiliency with the aim of improving the comfort of the user.

A left end part 22B and a right end part 22C on either side of the main frame 22 are positioned outwardly on either side of the user, and are each provided with a power generator mainly consisting of a motor unit 26, 28. The upper end of each motor unit 26, 28 is connected to the corresponding end part 22B, 22C of the main frame 22 via a hinge having a hinge axis extending in the coronal axis (front/back directional axis) of the user so that the motor unit 26, 28 is suspended from the upper end part, and can rotate around the hinge axis within a prescribed angular range.

Along the inner side of the main frame 22 extends an abdominal belt 30, which is wrapped around the abdominal part of the user. The abdominal belt 30 of this embodiment includes a left side belt 36, a right side belt 38 and a front belt 40. These parts 36, 38 and 40 are each made of flexible materials such as fabric and leather.

The left side belt 36 is passed through an opening 51B of a left engagement piece 51, and the two ends of the left side belt 36 are attached to an upper and lower part of the inner side of the middle part 22A of the main frame 22, respectively, so as to form a loop. Therefore, the left side belt 36 is reversed over in the shape of letter V at the left engagement piece 51. The length of the left side belt 36 can be adjusted by using a belt length adjustment buckle (not shown in the drawings) provided in a middle part of the belt. The left hook engagement piece 51 is made of plastic or metallic material, and is further provided with a left hook shaped part 51A.

Similarly, the right side belt 38 is passed through an opening 52B of a right engagement piece 52, and the two ends of the right side belt 38 are attached to an upper and lower part of the inner side of the middle part 22A of the main frame 22, respectively, so as to form a loop. Therefore, the right side belt 38 is reversed over in the shape of letter V at the right engagement piece 52. The length of the right side belt 38 can be adjusted by using a belt length adjustment buckle (not shown the drawings) provided in a middle part of the belt. The right engagement piece 52 is made of plastic or metallic material, and is further provided with a right hook shaped part 52A.

In the illustrated embodiment, each of the left and right engagement pieces 51 and 52 is made of a flat plate member having a slightly greater width than the belts 36 and 38.

Each end of the front belt 40 is fitted with a buckle 56, 58 provided with an opening 56A, 58A configured to receive the hook shaped part 51A, 52A of the corresponding engagement piece 51, 52. Each of the buckles 56, 58 is provided with a pair of rectangular openings 56B and 58B separated by a lateral bar for passing the corresponding end of the front belt 40 in a length adjustable manner. The left and right buckles 56 and 58 are each made of a flat plate member having a slightly greater width than the front belt 40.

Therefore, the front belt 40 can be detachably connected to the left and right side belts 36 and 38 by engaging the hook shaped parts 51A and 52A of the engagement pieces 51 and 52 with the openings 56A and 58A of the corresponding buckles 56 and 58. When the three parts of the abdominal belt 30 are connected to one another as described above, the abdominal belt 30 forms a loop that surrounds the abdominal part of the user. By suitably adjusting the length of each part of the abdominal belt 30 and snugly wrapping the abdominal belt 30 around the abdominal part of the user, the main frame 22 can be securely fitted to the pelvic part of the user without causing discomfort to the user.

The pelvic support assembly 20 further comprises a left supporter piece 44 and a right supporter piece 46. Each supporter piece 44, 46 is made of relatively stiff sheet member having a vertical width greater than the combined width of the two runs of the corresponding abdominal belt 36, 38 extending along the outer surface of the supporter piece 44, 46. Each supporter piece 44, 46 has a base end located between the back support member 24 and corresponding side belt 36, 38, and is jointly secured to the main frame 22, and extends along the inner surface of the side belt 36, 38. To impart a suitable stiffness to each supporter piece 44, 46, a resilient plastic or metallic wire 44A, 46A may be incorporated in the supporter piece 44, 46, for instance, along the outer periphery thereof.

Thus, the supporter pieces 44 and 46 are flexible enough to conform to the contour of the pelvic part of the user but stiff enough to distribute the pressure from the left and right side belts 36 and 38 over a large area of the body of the user so that the comfort of the user may be enhanced. Also, in order to increase the air breathability, and ensure the comfort to the user in a warm weather, the supporter pieces 44 and 46 may be at least partly made of a mesh type fabric or other air permeable material.

The base end of the left supporter piece 44 is secured to the middle part 22A of the main frame 22, and extends between the back support member 24 and left abdominal belt 36 as mentioned earlier. The free end of the left supporter piece 44 terminates at a point adjacent to the left engagement piece 52 in the illustrated embodiment, but may also extend slightly beyond the left engagement piece 52.

Similarly, the base end of the right supporter piece 46 is secured to the middle part 22A of the main frame 22, and extends between the back support member 24 and right abdominal belt 38. The free end of the right supporter piece 46 terminates at a point adjacent to the right engagement piece 54 in the illustrated embodiment, but may also extend slightly beyond the left engagement piece 52. The right supporter piece 46 extends along the side of the user in a similar fashion as the left supporter piece 44.

A stabilizer member 53, 54 is connected to each end part 22B, 22C of the main frame 22. Each stabilizer member is made of an elongated, relatively stiff plastic member having a base end pivotally attached to the inner side of the corresponding end part 22B, 22C via a pivot member so as to be rotatable around a pivot axis substantially in parallel with the sagittal axis or so as to be rotatable in the vertical direction.

Each stabilizer member 53, 54 has a free end 53A, 54A formed with a passage 53B, 54B through which the two runs of the corresponding side belt 36, 38 are passed. The passage 53B, 54B has a certain length so that the stabilizer member 53, 54 may evenly engage a corresponding length of each run of the belt. The free end 53A, 54A of each stabilizer member 53, 54 is attached to a free end part of the corresponding supporter piece 44, 46 via a cushioning member 55, 57 such as a foamed plastic piece.

The stabilizer members 53 and 54 are made of a relatively stiff molded elastomeric material such as vulcanized rubber. The main part of each stabilizer member 53, 54 consists of a strip member having a relatively large width as compared to the thickness thereof and having a major plane extending along the outer contour of the abdominal part of the user. Therefore, the stabilizer members 53 and 54 are compliant in the direction to conform to the outer contour of the abdominal part of the user, but is relatively stiff against the bending deformation in the vertical direction.

As the abdominal belt 30 is fastened around the abdominal part of the user, and is tightened, the stabilizer members 53 and 54 deflect inwardly against the body of the user, and the free ends 53A and 54A thereof are placed adjacent to or slightly above the anterior superior iliac spine of the user.

Each electric motor unit 26, 28 is positioned so as to coincide with the corresponding hip joint of the user, and is provided with an angular sensor (not shown in the drawings). To the output end of each electric motor unit 26, 28 on the exterior side thereof is releasably attached a base end part 60A, 62A of a swing arm 60, 62 in a torque transmitting relationship.

Figure 2:
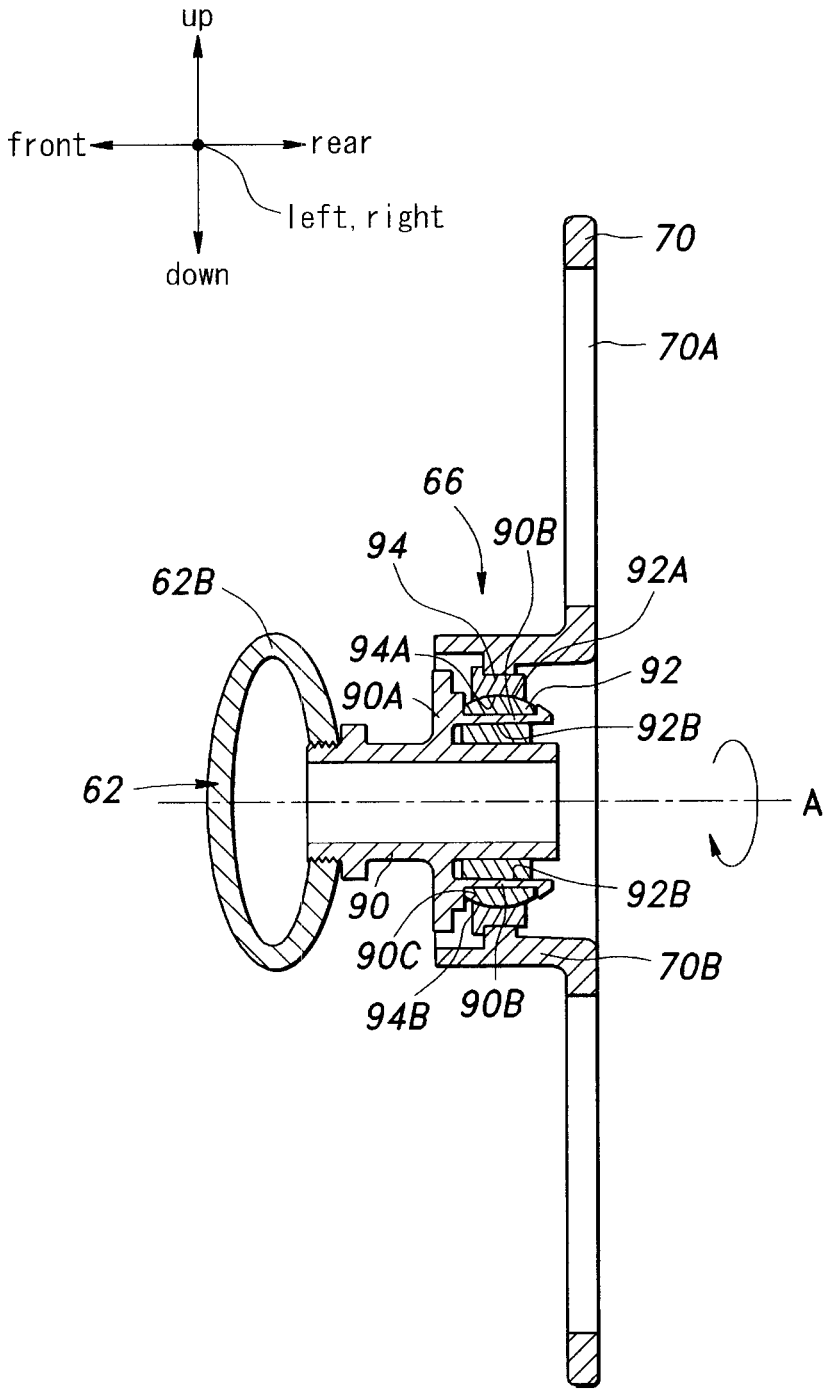
FIG. 2 is a sectional view showing a pivotal connection between a femoral support member and the free end of a swing arm.

Each swing arm 60, 62 is made of highly stiff and strong material such as aluminum, glass fiber reinforced plastic material, and carbon fiber reinforced plastic material. The main part of each swing arm 60, 62 consists of a hollow member having an elliptic cross section as illustrated in FIG. 2. The cross section of each swing arm 60, 62 is highly elongated along a major plane extending perpendicularly to the sagittal axial at the base end 60A, 62A thereof. Each swing arm 60, 62 is generally twisted so that the major plane of the free end 60B, 62B, which is located adjacent to a lower end of the femoral part, extends perpendicularly to the coronal axis.

The free end 6013, 62B of each swing arm 60, 62 is fitted with a front femoral support member 68, 70 via a coupling 64, 66 that permits angular movement of the femoral support member 68, 70 relative to the free end 60B, 62B of the swing arm 60, 62. Each front femoral support member 68, 70 is formed of a substantially rectangular plate member made of plastic material, and is curved in the shape of a part-cylindrical surface so as to conform to the outer contour of the lower femoral part of the user. Each front femoral support member 68, 70 is formed with a number of vertical slots 68A, 70A arranged laterally at a regular interval for promoting air permeability and enhancing resiliency with the aim of improving the comfort of the user.

The structure of the couplings 64 and 66 is described in the following. As the two couplings 64 and 66 are identical to each other in structure, only the right coupling 66 is discussed in the following description.

A mounting shaft 90 is attached to the free end 62B of the swing arm 62 via a thread fastener or welding so as to extend perpendicularly to the major plane of the swing arm 62. In other words, the mounting shaft 90 extends rearward from the free end 62B of the swing arm 62 in the front and back directions (coronal axis) of the walking assistance device 10. The part of the mounting shaft 90 adjacent to the rear end thereof is formed with a radial flange 90A, and a plurality of barbed pieces 90B extend rearward from the rear end surface of the radial flange 90A. An inner annular joint member 92 is fitted onto the rear end of the mounting shaft 90, and the barbed pieces 90B are passed into axial holes 92B passed through the corresponding parts of the inner annular joint member 92 so that the inner annular joint member 92 is fixedly attached to the rear end of the mounting shaft 90. The inner annular joint member 92 is provided with a spherical outer surface 92A.

The femoral support member 70 is centrally provided with a tubular hub 70B extending in the forward direction. An outer annular joint member 94 defining a spherical inner surface 94A is fixedly secured inside the tubular hub 70B. The inner annular joint member 92 is received in the outer annular joint member 94 so that the femoral support member 70 is allowed to rotate around both the vertical and horizontal axes or to tilt in any desired direction in the manner of a spherical joint. Furthermore, the femoral support member 70 is allowed to rotate around the axial line A of the mounting shaft 90 with respect to the swing arm 62.

Figure 3:
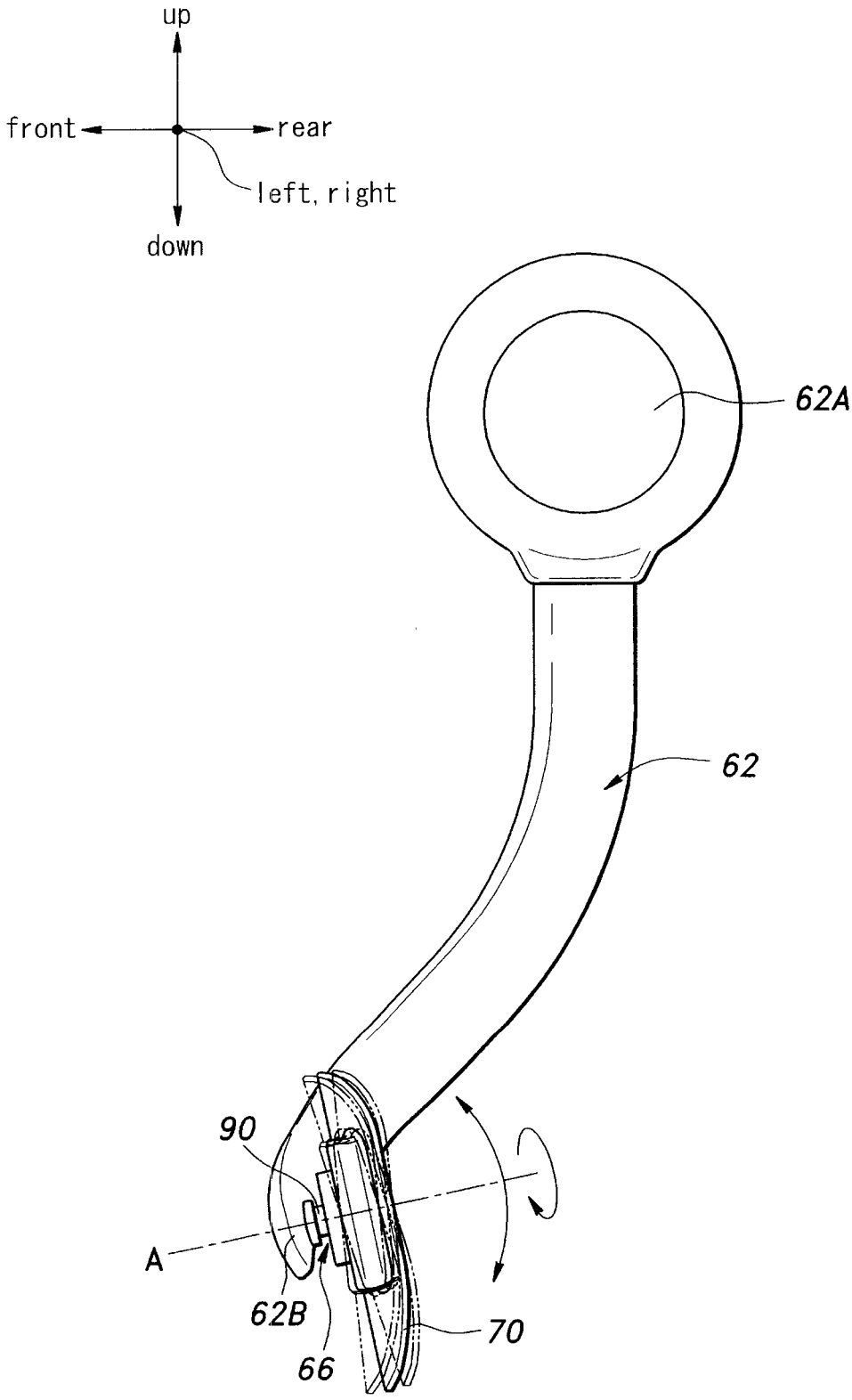
FIG. 3 is a fragmentary side view of the swing arm and femoral support member showing a range of angular movement between them.

The extent of the tilting movement of the femoral support member 70 with respect to the swing arm 62 is restricted by the engagement between a stopper surface 94B of the outer annular joint member 94 and a corresponding stopper surface 90C of the mounting shaft 90. Therefore, the femoral support member 70 is allowed to tilt from a reference position (indicated by the solid lines in FIG. 3) by an angle of about 5 degrees, for instance, in all directions (as indicated by the imaginary lines in FIG. 3). Thereby, the femoral support member 70 can accommodate the different builds of the users without excessively tilting to the inconvenience of the user who tries to wear the femoral support member 70 on him or her.

Figure 4:
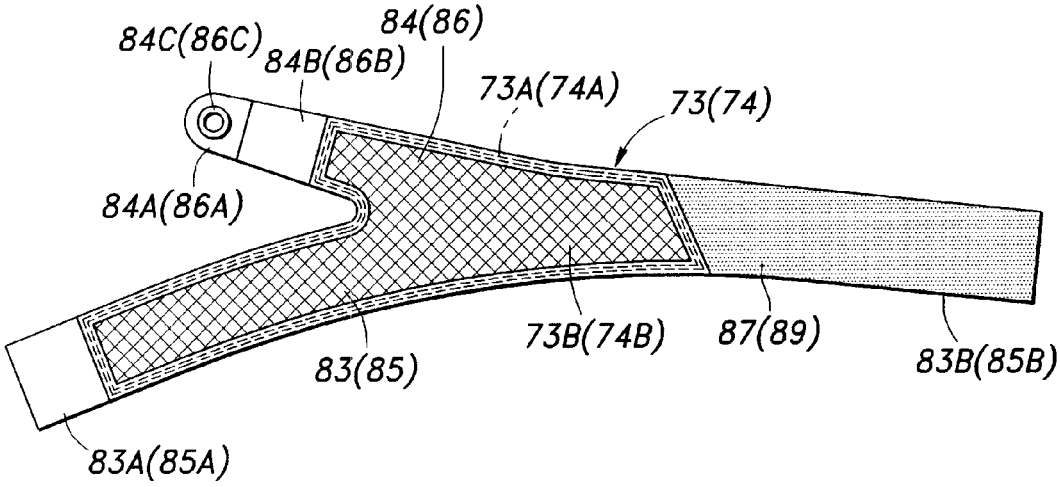
FIG. 4 is a developed view of a femoral belt of the walking assistance device.

Each femoral support member 68, 70 is fitted with a femoral belt 73, 74 for retaining the femoral support member 68, 70 to the femoral part of the user as shown in FIG. 1. FIG. 4 shows the femoral belt 73, 74 in greater detail. Each femoral belt 73, 74 includes a main belt portion 83, 85 that surrounds the femoral part of the user in cooperation with the corresponding femoral support member 68, 70, and an auxiliary belt portion 84, 86 integrally bifurcated from an intermediate part of the main belt portion 83, 85. The two femoral belts 73 and 74 are mirror images of each other.

The femoral support assembly is now described in the following. As the two femoral support assemblies are mirror images of each other, only the right femoral support assembly is described in the following. A first end 83A of the main belt portion 83 is secured to a belt engaging bar 68B extending vertically on one lateral side of the femoral support member 68, and a second end 83B of the main belt portion 83 is fitted with a tongue piece 75. The tongue piece 75 includes four lateral bars and a pair of longitudinal bars connecting the corresponding ends of the lateral bars. The femoral belt 73 is passed through an opening 75B defined between the second and third lateral bars from inside to outside, and is then passed through the opening defined between the first and second lateral bars from outside to inside, the lateral bars being counted from the end adjacent to the femoral belt 73. Thus, the free end of the femoral belt 73 is passed between the first lateral bar and the remaining part of the femoral belt, from outside to inside. Thus, the femoral belt 73 is frictionally engaged against loosening when fastened while enabling the femoral belt 73 to be tightened by pulling the free end of the femoral belt 73. In the illustrated embodiment, a surface fastener 87 is attached to the outer side of the free end of the femoral belt 73 so that the parts of the femoral belt overlying each other near the base end of the tongue piece 75 can be joined to each other, and the femoral belt 73 is positively prevented from slackening during use.

If desired, the surface fastener may also be applied to the abdominal belt 30 or in particular the front belt 40 for the purpose of preventing the loosening or slackening of the abdominal belt 30.

The femoral support member 68 is formed with a hook portion 71 on the opposite lateral side thereof. The hook portion 71 is formed on the front side of the femoral support member 68 so as to define a hook opening facing away from the adjacent lateral edge of the femoral support member 68. Thereby, the tongue piece 75 can be secured to the femoral support member 68 by engaging the hook portion 71 in the opening defined between the first and second lateral bars of the tongue piece.

The free end of each auxiliary belt part 84 is fitted with a grommet 84C, and is connected to an intermediate part of the corresponding swing arm 62 via a pivot pin 88 fixedly secured to the swing arm 60 and rotatably received in the grommet 84C.

Thus, the main belt portion 83 is wrapped around the femoral part of the user by securing the base end of the main belt portion 83 to the belt engaging bar 68B of the femoral support member 68 and engaging the tongue piece 75 with the hook portion 71 provided on the opposite lateral end of the femoral support member 68.

The main belt portions 83 and 85 as well as the auxiliary belt portions 84 and 86 may be made of any flexible material such as fabric and leather, and may be at least partly made of mesh material as denoted in numerals 73B and 74B. Resilient plastic wires 73A, 73B are incorporated along the lateral edges of the mesh material 73B, 74B so that the femoral belt 73, 74 may maintain a curved shape so that the handling of the femoral belt 73, 74 may be improved during the fastening and releasing of the femoral belt.

In the illustrated embodiment, the auxiliary belt portions 84 and 86 are at least partly incorporated with elastic rubber belts 84B and 86B so that the variation in the build of the user may be accommodated by the extension and contraction of the auxiliary belt portions 84 and 86, and the comfort of the user may be improved.

Each femoral belt 73, 74 including the main belt portion 83, 85 and auxiliary belt portion 84, 86 assumes an inverted frustoconical shape when the free end of the main belt portion 83, 85 is connected to the femoral support member 68, 70 via the belt buckle including the tongue piece 75, 76 and the hook portion 71, 72 so as to conform to the outer contour of the lower femoral part of the user. Thus, each femoral belt 73, 74 may be shaped three-dimensionally by using the draping technique so as to optimally conform to the femoral part of the user.

Thus, the free end of each swing arm 60, 62 can engage the lower part of the corresponding femoral part of the user by passing the femoral belt 73, 74 around the femoral part of the user, and engaging the hook-shaped part 71, 72 with the opening 75A, 76A of the corresponding tongue piece 75, 76. By appropriately tightening the femoral belt 73, 74 by using the tension adjusting feature of the tongue piece 75, 76, the femoral part of the user can be securely but releasably engaged by the free end of the swing arm 60, 62.

By actuating the motor units 26 and 28 in dependence on the walking effort made by the user (which can be detected by using suitable load sensors not shown in the drawings), the user is assisted in the effort to walk not only by the assisting power provided by the motor units 26 and 28 but also by the gait or pace also provided by the motor units 26 and 28 for the purpose of helping the user regain the motor coordination required for walking. The motor units 26 and 28 are provided with angular sensors so that the angular movements of the motor units 26 and 28 may be accurately controlled by feedback control.

As discussed earlier, each femoral support member 68, 70 is connected to the free end of the corresponding swing arm 60, 62 in such a manner that the femoral support member 68, 70 can rotate around the axial line A of the mounting shaft 90 and tilt with respect to the axial line A in any desired direction. Thereby, the femoral support member 68, 70 is enabled to closely fit on the front side of the lower femoral part of the user in spite of the variations in the build of the user so that the power of the electric motor unit 26, 28 can be applied to the femoral part of the user in a reliable manner without causing discomfort or stress to the user.

As the femoral support member 68, 70 is highly flexible in the lateral bending owing to the provision of the slots 68A, 70A, the femoral support member is enabled to tightly fit on the front side of the lower femoral part of the user as the femoral belt 73, 74 is tightened. Because the two ends of the main belt portions 83, 85 of the femoral belt are 73, 74 attached to the respective lateral ends of the femoral support member, the femoral support member is prevented from being excessively deformed.

Because each femoral support member 68, 70 is provided with the hook portion 71, 72 for engaging the tongue piece 75, 76 of the femoral belt 73, 74, the location of the hook portion 71, 72 remains relatively fixed in relation with the swing arm 60, 62 at any time, engaging and disengaging the tongue piece 75, 76 with and from the hook portion 71, 72 can be accomplished with ease even by using a single hand. This advantage is even more enhanced by limiting the maximum tilting angle of the femoral support member 68, 70 with respect to the swing arm 60, 62.

Because each femoral belt 73, 74 is connected to the swing arm 60, 62 and femoral support member 68, 70 at the two ends of the main belt portion 83, 85 and the free end of the auxiliary belt portion 84, 86, the femoral belt 73, 74 can be worn on the femoral part of the user in a stable manner, minimizing the possibility of the femoral support member 68, 70 shifting in position with respect to the femoral part of the user.

In particular, each auxiliary belt portion 84, 86 performs the function of suspending an intermediate part of the corresponding main belt portion 83, 85 so that the downward shifting of the main belt portion 83, 85 during the operation of the walking assistance device can be positively prevented. Therefore, each femoral support member 68, 70 is maintained on the prescribed position of the lower femoral part of the user even after an extensive operation of the walking assistance device, and the power produced by the electric motor unit 26, 28 can be transmitted to the femoral part of the user in a highly effective manner.

When the tension of each femoral belt 73, 74 wrapped around the lower femoral part of the user is desired to be adjusted, it can be accomplished simply by releasing the engagement of the free end of the femoral belt and adjacent part of the femoral belt by the surface fastener, and refastening the surface fastener after pulling or releasing the femoral belt as required. In particular, this adjustment can be accomplished by using only one hand.

As each femoral belt 73, 74 is given with an inverted frustoconical shape that conforms to the outer contour of the lower femoral part of the user when the free end of the femoral belt is engaged by the hook portion of the femoral support member via the tongue piece, the femoral support member can be favorably fitted on the front side of the lower femoral part of the user. When each auxiliary belt portion is at least partly formed by elastic rubber belts that allow the auxiliary belt portion to be resiliently elongated in the lengthwise direction, the femoral belt can accommodate the variations in the build of the user and changes in the girth of the femoral part of the user resulting from the movements of the muscles in the femoral part of the user.

Although the present invention has been described in terms of a preferred embodiment thereof, it is obvious to a person skilled in the art that various alterations and modifications are possible without departing from the scope of the present invention which is set forth in the appended claims.

The contents of the original Japanese patent applications on which the Paris Convention priority claim is made for the present application are incorporated in this application by reference.

The invention claimed is:

1. A walking assistance device configured to apply a walking assistance force to a femoral part of a user, comprising:

a pelvic support assembly configured to be worn on a pelvic part of a user to support a power generator and a femoral support assembly configured to transmit a walking assistance force generated by the power generator to a femoral part of the user;

wherein the pelvic support assembly comprises a main frame configured to be worn on a pelvic part of the user and extending from a lower back of the user to either side of the pelvic part of the user forming a C-shape in plan view, at least one free end of the main frame being configured to support the power generator at a position corresponding to a hip joint of the user, and an abdominal belt attached to the main frame at base ends thereof, extending along an inner periphery of the main frame and configured to be detachably passed along an abdominal part of the user; and wherein the femoral support assembly comprises a swing arm having a base end connected to an output end of the power generator and a free end adapted to oppose a front part of the femoral part of the user, a femoral support member pivotally connected to the free end of the swing arm and having a support surface, the swing arm and the femoral support member configured such that the femoral support member is adapted to have the support surface engage the front part of the femoral part of the user, and a femoral belt adapted to pass around the femoral part of the user and having two ends attached to corresponding lateral ends of the femoral support member.

2. The walking assistance device according to claim 1, wherein the free end of the swing arm and femoral support member are provided with mutually cooperating stopper surfaces that limit a tilting movement of the femoral support member relative to the free end of the swing arm within a prescribed limit.

3. The walking assistance device according to claim 1, wherein the femoral support member comprises a plate member having a plurality of vertical slots arranged laterally formed therein.

4. The walking assistance device according to claim 1, wherein the femoral support member is provided with a pair of engagement features on either lateral end, one of the engagement features permanently engaging the corresponding end of the femoral belt while the other engagement feature releasably engages the other end of the femoral belt.

5. The walking assistance device according to claim 1, wherein the femoral belt is at least partly elastic.

6. The walking assistance device according to claim 1, wherein the femoral belt is provided with a frustoconical shape when the two ends of the femoral belts are engaged by the femoral support member.

7. The walking assistance device according to claim 1, wherein the swing arm is a single piece having twisted shape such that the base end connects to the output end of the power generator and the free end is adapted to oppose the front part of the femoral part of the user with a major plane of the free end extending perpendicularly to a coronal axis of the user.

8. A walking assistance device configured to apply a walking assistance force to a femoral part of a user, comprising:

a pelvic support assembly configured to be worn on a pelvic part of a user to support a power generator and a femoral support assembly configured to transmit a walking assistance force generated by the power generator to a femoral part of the user;

wherein the pelvic support assembly comprises a main frame configured to be worn on a pelvic part of the user and extending from a lower back of the user to either side of the pelvic part of the user forming a C-shape in plan view, at least one free end of the main frame being configured to support the power generator at a position corresponding to a hip joint of the user, and an abdominal belt attached to the main frame at base ends thereof, extending along an inner periphery of the main frame and configured to be detachably passed along an abdominal part of the user; and wherein the femoral support assembly comprises a swing arm having a base end connected to an output end of the power generator and a free end adapted to oppose a front part of the femoral part of the user, a femoral support member pivotally connected to the free end of the swing arm and having a support surface, the swing arm and the femoral support member configured such that the femoral support member is adapted to have the support surface engage the front part of the femoral part of the user, and a femoral belt adapted to pass around the femoral part of the user and having two ends attached to corresponding lateral ends of the femoral support member, wherein the free end of the swing arm is connected to the femoral support member via a spherical joint.

9. The walking assistance device according to claim 8, wherein the femoral support member is pivotally connected directly to the free end of the swing arm via the spherical joint.

10. A walking assistance device configured to apply a walking assistance force to a femoral part of a user, comprising:

a pelvic support assembly configured to be worn on a pelvic part of a user to support a power generator and a femoral support assembly configured to transmit a walking assistance force generated by the power generator to a femoral part of the user;

wherein the pelvic support assembly comprises a main frame configured to be worn on a pelvic part of the user and extending from a lower back of the user to either side of the pelvic part of the user forming a C-shape in plan view, at least one free end of the main frame being configured to support the power generator at a position corresponding to a hip joint of the user, and an abdominal belt attached to the main frame at base ends thereof, extending along an inner periphery of the main frame and configured to be detachably passed along an abdominal part of the user;

wherein the femoral support assembly comprises a swing arm having a base end connected to an output end of the power generator and a free end adapted to oppose a front part of the femoral part of the user, a femoral support member pivotally connected to the free end of the swing arm and having a support surface adapted to engage the front part of the femoral part of the user, and a femoral belt adapted to pass around the femoral part of the user and having two ends attached to corresponding lateral ends of the femoral support member;

wherein the femoral support member is provided with a pair of engagement features on either lateral end, one of the engagement features permanently engaging the corresponding end of the femoral belt while the other engagement feature releasably engages the other end of the femoral belt; and wherein the femoral belt includes a main belt portion having a base end permanently connected to one of the lateral ends of the femoral support member and a free end releasably connected to the other lateral end of the femoral support member via a buckle, and an auxiliary belt portion bifurcated from an intermediate part of the main belt portion and having a free end connected to an intermediate part of the swing arm.

11. The walking assistance device according to claim 10, wherein the buckle includes a tongue piece connected to the free end of the main belt portion and a corresponding engagement feature provided on the corresponding lateral end of the femoral support member, and the tongue piece includes at least a pair of lateral bars arranged in a lengthwise direction of the femoral belt, the free end of the femoral belt being wrapped around one of the lateral bars and passed between the other lateral bar and an adjacent part of the femoral belt, and opposing surfaces of the two adjacent parts of the femoral belt being provided with mutually cooperating surface fastener parts.

* * * * *